US008232951B2

(12) United States Patent
Hsu et al.

(10) Patent No.: US 8,232,951 B2
(45) Date of Patent: Jul. 31, 2012

(54) DYNAMIC IMAGE CONTROL DEVICE USING COINCIDENT BLANK INSERTION SIGNALS

(75) Inventors: Tien-Chu Hsu, Taoyuan (TW); Yu-An Liu, Taoyuan (TW)

(73) Assignee: Chunghwa Picture Tubes, Ltd., Padeh, Taoyuan County, Taoyuan (TW)

( * ) Notice: Subject to any disclaimer, the term of this patent is extended or adjusted under 35 U.S.C. 154(b) by 983 days.

(21) Appl. No.: 12/197,634

(22) Filed: Aug. 25, 2008

(65) Prior Publication Data

US 2010/0045688 A1 Feb. 25, 2010

(51) Int. Cl.
*G09G 3/36* (2006.01)

(52) U.S. Cl. ..... 345/98; 345/204; 345/87

(58) Field of Classification Search ..... 345/545, 345/89, 204, 98
See application file for complete search history.

(56) References Cited

U.S. PATENT DOCUMENTS

| | | | | |
|---|---|---|---|---|
| 2007/0085794 | A1* | 4/2007 | Kawabe et al. | 345/89 |
| 2007/0120803 | A1* | 5/2007 | Nakamura et al. | 345/98 |
| 2007/0146292 | A1* | 6/2007 | Li et al. | 345/100 |
| 2007/0182680 | A1* | 8/2007 | Jeon | 345/87 |

FOREIGN PATENT DOCUMENTS

| | | | |
|---|---|---|---|
| CN | 1410956 | A | 4/2003 |
| CN | 101008724 | A | 8/2007 |

* cited by examiner

*Primary Examiner* — Quan-Zhen Wang
*Assistant Examiner* — David Lee
(74) *Attorney, Agent, or Firm* — Winston Hsu; Scott Margo

(57) ABSTRACT

An image control device has display signals and blank insertion (BI) signals. Polarities of the display signals and those of the BI signals are coincident. Thus, BI signals are displayed in a way of 1+2 line inversion and differences of response times are eliminated to avoid affecting MPRT.

6 Claims, 11 Drawing Sheets

A

| | | | | | |
|---|---|---|---|---|---|
| + | − | − | + | + | − |
| − | + | + | − | − | + |
| + | − | − | + | + | − |
| − | + | + | − | − | + |
| + | − | − | + | + | − |
| − | + | + | − | − | + |
| + | − | − | + | + | − |
| − | + | + | − | − | + |

B

| | | | | | |
|---|---|---|---|---|---|
| − | + | + | − | − | + |
| + | − | − | + | + | − |
| − | + | + | − | − | + |
| + | − | − | + | + | − |
| − | + | + | − | − | + |
| + | − | − | + | + | − |
| − | + | + | − | − | + |
| + | − | − | + | + | − |

C

| | | | | | |
|---|---|---|---|---|---|
| + | − | − | + | + | − |
| − | + | + | − | − | + |
| + | − | − | + | + | − |
| − | + | + | − | − | + |
| + | − | − | + | + | − |
| − | + | + | − | − | + |
| + | − | − | + | + | − |
| − | + | + | − | − | + |

D

| | | | | | |
|---|---|---|---|---|---|
| + | − | − | + | + | − |
| − | + | + | − | − | + |
| + | − | − | + | + | − |
| − | + | + | − | − | + |
| + | − | − | + | + | − |
| − | + | + | − | − | + |
| + | − | − | + | + | − |
| − | + | + | − | − | + |

FIG.5

DYNAMIC IMAGE CONTROL DEVICE USING COINCIDENT BLANK INSERTION SIGNALS

FIELD OF THE INVENTION

The present invention relates to image control device; more particularly, relates to displaying BI signals in a way of 1+2 line inversion for coinciding polarities of BI data with those of display data, where differences of response times are thus eliminated to avoid affecting motion picture response time (MPRT).

DESCRIPTION OF THE RELATED ART

Blank insertion (BI) is usually used to improve screen quality. With the BI data, integration effect of image to human eye is eliminated and Image sticking of LCD TV is solved. However, the BI data are written in with the same polarities at one time, which are not coincident with the display data. Thus, response times of neighboring pixels may not be coincident and pixel color may be come in correct.

Generally, a few continuous gate lines are opened to be written with BI data at one time. That is, a few horizontal lines are continuously opened to be mixed among normal display data. As shown in FIG. 11, the four horizontal data 50, 51, 52, 53 are displayed at the bottom of the screen. Another four horizontal lines are opened at the same time for writing in blank data at the upper side of the screen. Thus, one BI data is added after every four horizontal data 50, 51, 52, 53 with a frequency improved for 1.25 times (i.e. (4+1)/4).

This method is easily used in designing a timing controller (Tcon); but is not so fit for horizontal polarities. Four lines are opened at one time and signals having the same polarities are written in simultaneously, which is a way different from 1+2 line inversion for writing in original display data with corresponding polarities. Thus, response times may be affected and inconsistent. Hence, the prior art does not fulfill all users' requests on actual use.

SUMMARY OF THE INVENTION

The main purpose of the present invention is to display BI signals in a way of 1+2 line inversion for coinciding polarities of display data with those of BI data, where differences of response times are thus eliminated to avoid affecting MPRT.

To achieve the above purpose, the present invention is a dynamic image control device using coincident BI signals, comprising a sequence control unit for controlling timing sequence data; a data access unit connecting to the sequence control unit for accessing required data; a buffer unit connecting to the data access unit for buffering the required data; a register connecting to the sequence control unit for buffering the timing sequence data; a memory unit connecting to the register for storing the timing sequence settings; a data output unit connecting to the sequence control unit and the data access unit for outputting data; and a driving signal unit connecting to the data sequence control unit and the register for outputting driving signals, where the driving signal unit outputs a STH signal, a TP signal, a POL signal, a STV signal, a VCLK signal and a plurality of OE signals; control waveform of each of the TP signal, the POL signal, the STV signal, the VCLK signal and the OE signal is divided into a display section and a BI section; the VCLK signal in the display section comprises cyclic signals and each of the cyclic signal comprises sequential signals of a first VCLK pulse signal and a second VCLK pulse signal; the STV signal in the display section is a high level signal at the second VCLK pulse signal; the OE signal in the display section comprises cyclic signals and each of the cyclic signal comprises sequential signals of a first OE low potential signal, an OE high potential signal and a second OE low potential signal; the VCLK signal in the BI section comprises cyclic signals and each of the cyclic signal comprises sequential signals of a first VCLK pulse signal and a second VCLK pulse signal; the STV signal in the BI section is a high level signal during the second VCLK pulse signal of a cyclic signal of the VCLK signal and the first VCLK pulse signal of next cyclic signal of the VCLK signal; and the OE signal in the BI section comprises cyclic signals and each of the cyclic signal comprises sequential signals of a first OE high potential signal, an OE low potential signal and a second OE high potential signal. Accordingly, a novel dynamic image control device using coincident BI signals is obtained.

BRIEF DESCRIPTION OF THE DRAWINGS

The present invention will be better understood from the following detailed descriptions of the preferred embodiments according to the present invention, taken in conjunction with the accompanying drawings, in which

FIG. 5 is the view showing the polarities of the first preferred embodiment;

DESCRIPTIONS OF THE PREFERRED EMBODIMENTS

The following descriptions of the preferred embodiments are provided to understand the features and the structures of the present invention.

Figure 1:
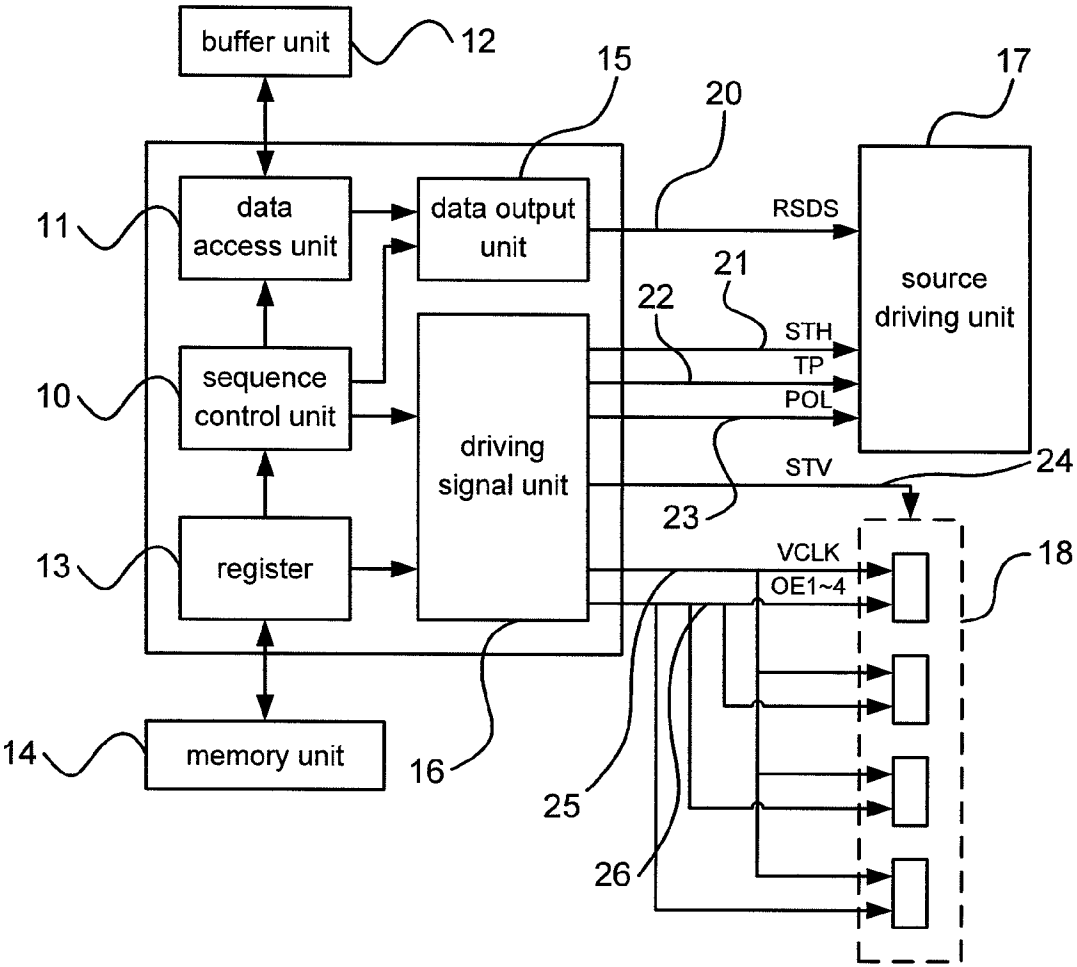
FIG. 1 is the view showing the structure according to the present invention.
Figure 2:
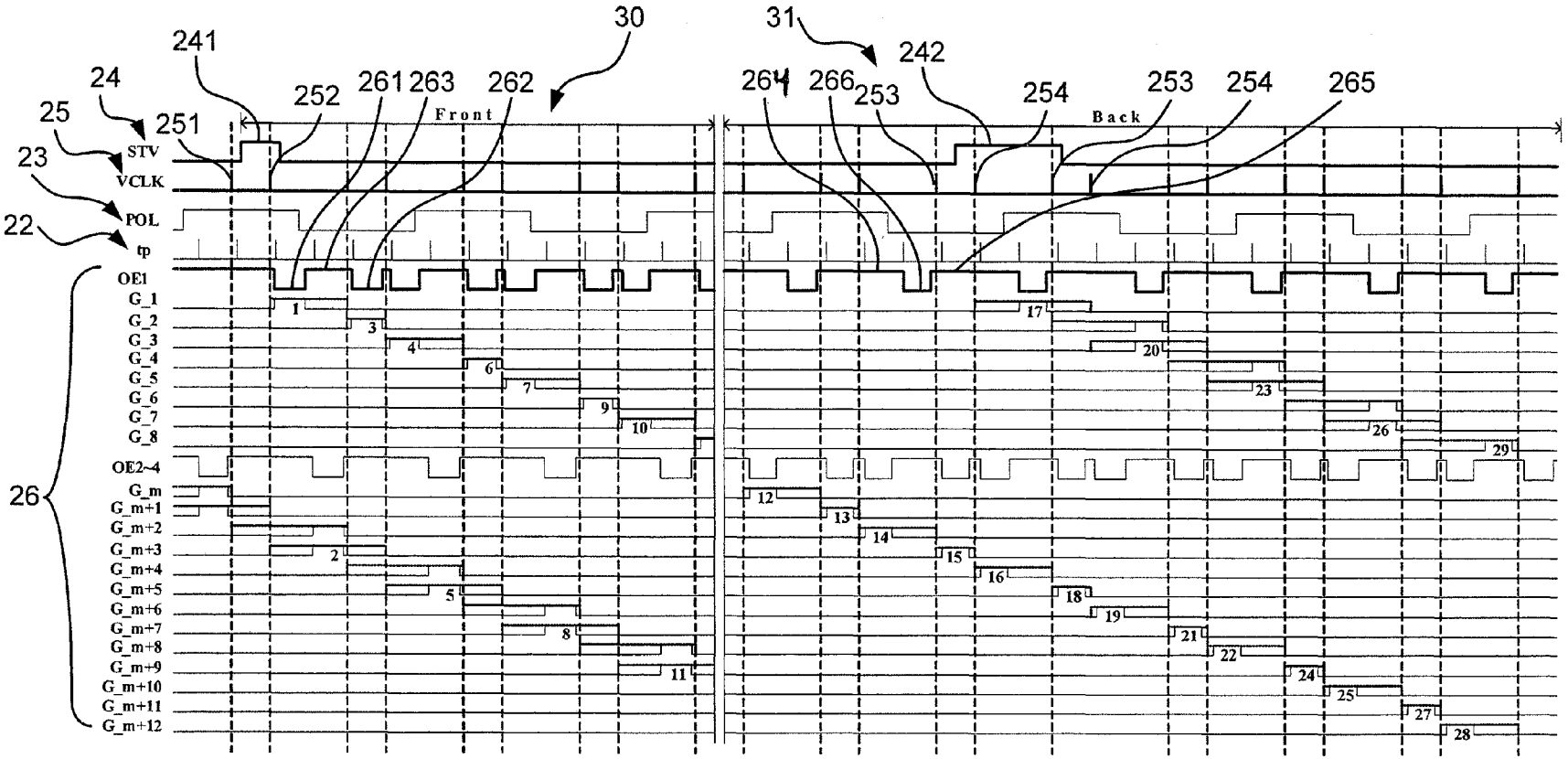
FIG. 2 is the view showing the control waveforms of the first preferred embodiment.

Please refer to FIG. 1, which is a view showing a structure according to the present invention. As shown in the figure, the present invention is a dynamic image control device using coincident blank insertion (BI) signals, comprising a sequence control unit 10, a data access unit 11, a buffer unit 12, a register 13, a memory unit 14, a data output unit 15 and a driving signal unit 16.

The sequence control unit 10 controls timing sequence data.

The data access unit 11 is connected with the sequence control unit 10 to access required data.

The buffer unit 12 is connected with the data access unit 11 to buffer the required data.

The register 13 is connected with the sequence control unit 10 to buffer the timing sequence data.

The memory unit 14 is connected with the register to store the timing sequence data.

The data output unit 15 is connected with the sequence control unit 10 and the data access unit 11 to output data. And the data output unit 15 is connected with a source driving unit 17 to output a reduced swing differential signal (RSDS).

The driving signal unit 16 is connected with the sequence control unit 10 and the register 13 to output driving signals. And the driving signal unit 16 is connected with the source driving unit 17 to output a STH signal 21, a TP signal 22 and a POL signal 23; and is connected with a gate driving unit 18 to output a STV signal 24, a VCLK signal 25 and a plurality of OE signals 26. The TP signal 22 is a transference control signal for the source driving unit 17. And the source driving unit 17 transfers crystal signals to pixels of a horizontal line while activating the TP signal 22. The POL signal 23 is a polarity control signal for output signals of the source driving unit 17, where an output signal is shown as high for a positive polarity or is shown as low for a negative polarity. The STV signal 24 is a start pulse for the register 13 (a shift register) in the gate driving unit 18. On activating the STV signal 24, each horizontal line is opened sequentially along with the VCLK signal 25 and the OE signal 26. The VCLK signal 25 is a trigger signal to the register 13, where, on activating the VCLK signal 25, a value in the register 13 in the gate driving unit 18 is shifted and the OE signal 26 controls openings of horizontal lines. The OE signal 26 is an output control signal for the gate driving unit 18. When the OE signal 26 is shown as 'high', output of the gate driving unit 18 is disabled because an output of a horizontal line is forced to have potential too low to be opened for signaling pixels. On the contrary, when the OE signal 26 is shown as 'low', the register 13 is at a high position and a high potential is outputted to a horizontal line for writing display signals by the source driving unit 17. Thus, with the above structure, a novel dynamic image control device using coincident blank insertion signals is obtained.

Please refer to FIG.2 to FIG.6, which are a view showing control waveforms of a first preferred embodiment; views showing waveforms of a display section and a BI section 31 of the first preferred embodiment; a view showing polarities of the first preferred embodiment; and a view showing waveforms of the first preferred embodiment. As shown in the figures, control waveform of each of a TP signal, a POL signal, an STV signal, a VCLK signal and an OE signal is divided into a display section 30 and a BI section 31.

The VCLK signal 25 in the display section 30 comprises cyclic signals and each cyclic signal comprises sequential signals of a first VCLK pulse signal 251 and a second VCLK pulse signal 252. The STV signal 24 in the display section 30 is a high level signal 241 in the second VCLK pulse signal 252. The OE signal 26 in the display section 30 comprises cyclic signals and each cyclic signal comprises sequential signals of a first OE low potential signal 261, an OE high potential signal 263 and a second OE low potential signal 262.

The VCLK signal 25 in the BI section 31 comprises cyclic signals and each cyclic signal comprises sequential signals of a first VCLK pulse signal 253 and a second VCLK pulse signal 254. The STV signal 24 in the BI section 31 is a high level signal 242 during the second VCLK pulse signal 254 of a cyclic signal of the VCLK signal 25 and the first VCLK pulse signal 253 of next cyclic signal of the VCLK signal 25. The OE signal 26 in the BI section 31 comprises cyclic signals and each cyclic signal comprises sequential signals of a first OE high potential signal 264, an OE low potential signal 266 and a second OE high potential signal 265.

Figure 3:
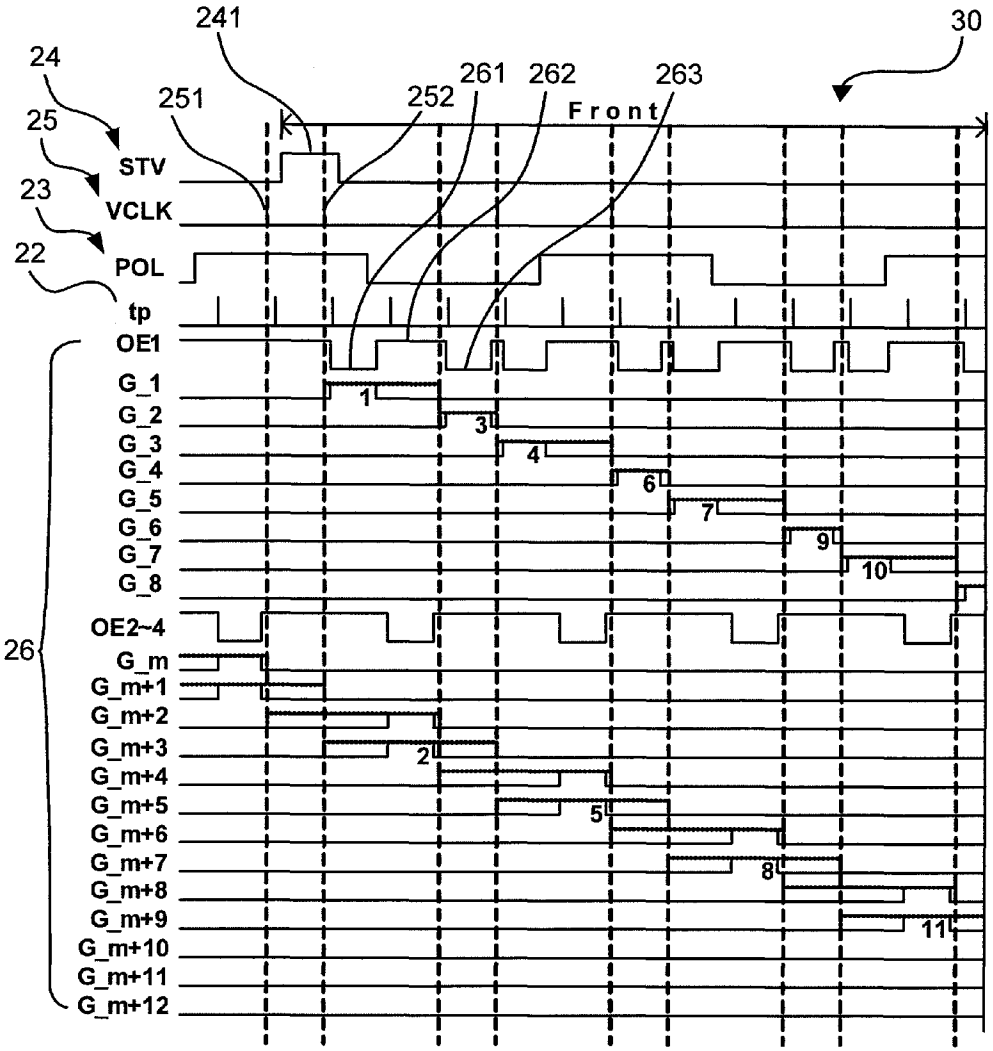
FIG. 3 is the view showing the waveforms of the display section of the first preferred embodiment.

The display section 30 displays signals. When the STV signal 24 is triggered by the VCLK signal 25 for displaying the signals, all gates except the first gate are cyclically opened for two time periods together with an interval of one time period through controls by the VCLK signal 25 and the OE signal 26. As shown in FIG. 3, the gates are sequentially opened from the first line at time periods 1, 3, 4, 6, 7, 9, 10, and so forth; and data are written in to be display with polarities of 1+2 line inversion. In a prior half of the display section 30, two gates are opened every two time periods on a specific position of a screen at time periods 2, 5, 8, 11, and so forth; and blank data are written in with coincident polarities, which are the BI signals from a latter half of the previous frame.

Figure 4:
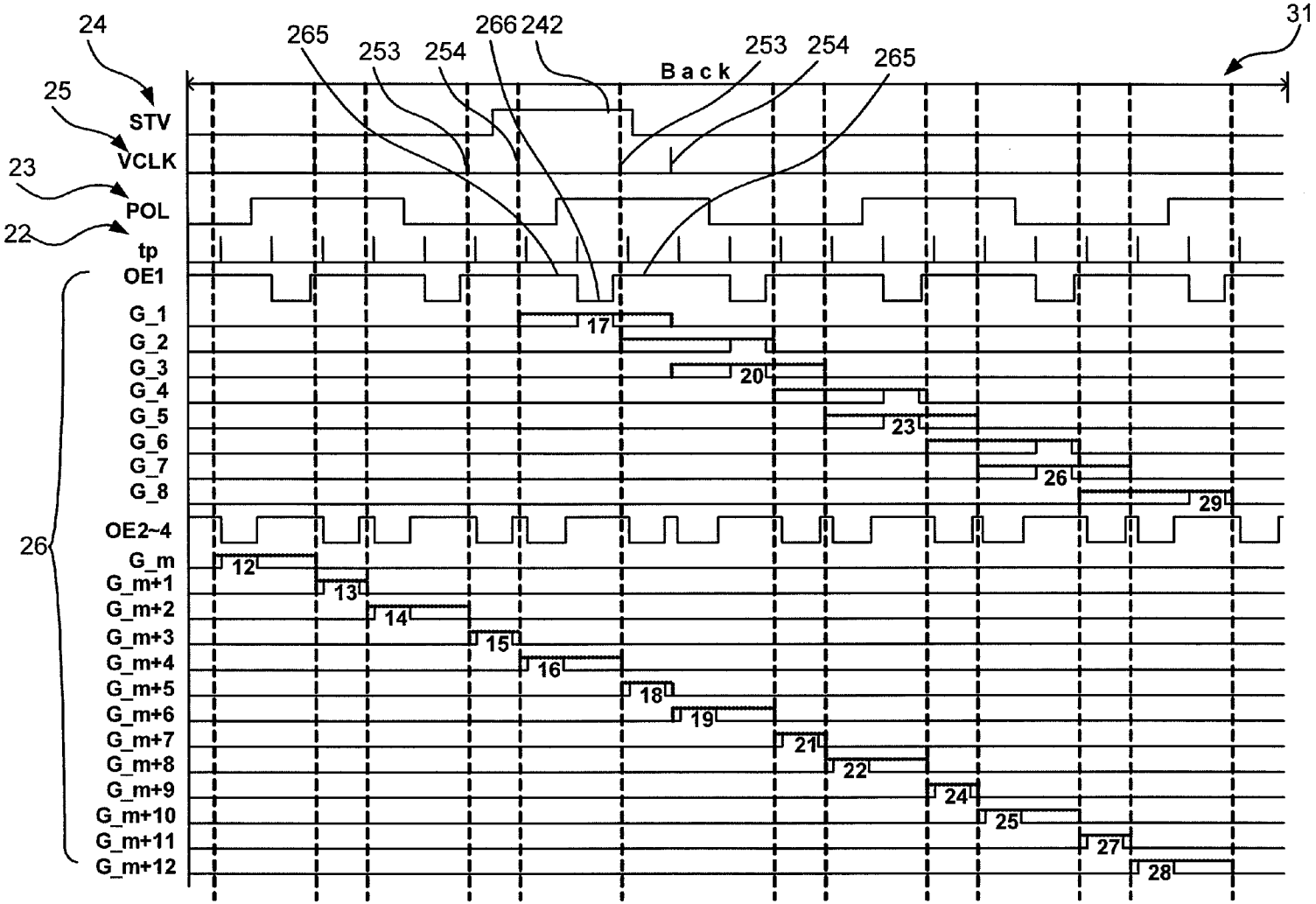
FIG. 4 is the view showing the waveforms of the BI section of the first preferred embodiment.

The BI section 31 comprises BI signals, whose STV signal 24 crosses two VCLK signals 25. Under control by the VCLK signal 25, the OE signal 26 and the POL signal 23, all gates except the first gate are cyclically opened for two time periods together with an interval of one time period. As shown in FIG. 4, except the first and the last gates, all the gates are opened by two at time periods 17, 20, 23, 26, 29, and so forth; and BI signals are written in with coincident polarities. And, gates are opened to write in display signals at time periods 12, 13, 14, 15, 16, 18, 19, 21, 22, 24, 25, 27, 28, and so forth. Thus, with the above structure, the display signals and the BI signals use the same source driving unit 17 simultaneously.

Figure 6:
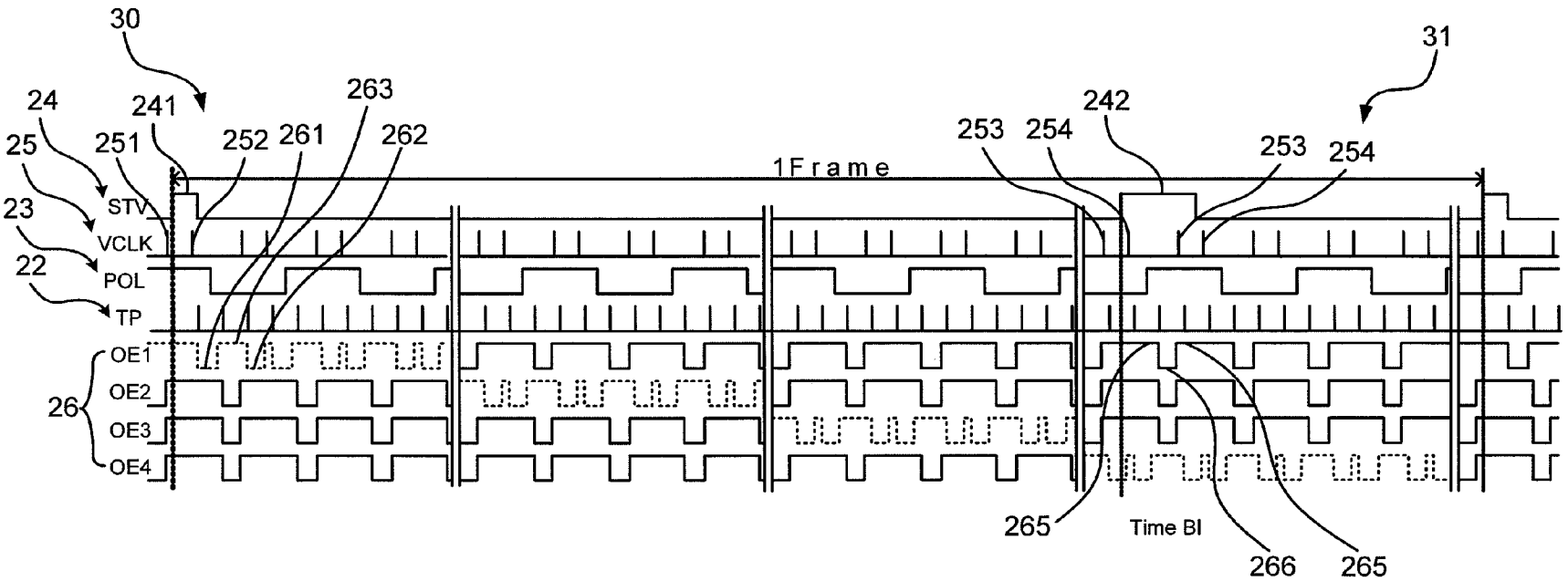
FIG. 6 is the view showing the waveforms of the first preferred embodiment.

As shown in FIG. 5, polarities of screen A, B, C and D are the same both in the BI section and in the display section. As shown in FIG. 6, the dotted-line parts of the OE signal 26 are display signals, switching from OE1 to OE4 for displaying a frame. The other parts of the OE signal 26 are BI signals. Time BI in FIG. 6 is the start time for BI, whose position is changeable but not for the dotted-line parts of OE1. When Time BI has a different position, the screen has a different rate of BI accordingly. The number of OE signals is unlimited but has to be greater than two. In this way, with two time periods for horizontal display signal and one time period for horizontal BI signal, display frequency is improved for (2+1)2=1.5 times.

Please refer to FIG. 7 to FIG. 10, which are views showing waveforms of a display section and a BI section of a second preferred embodiment; and views showing polarities and waveforms of the second preferred embodiment. As shown in the figures, a VCLK signal 25*a* in a display section 40 comprises cyclic signals and each cyclic signal comprises sequential signals of a first VCLK pulse signal 250*a*, a second VCLK pulse signal 251*a*, a third VCLK pulse signal 252*a*, a fourth VCLK pulse signal 253*a*, a fifth VCLK pulse signal 254*a*, a sixth VCLK pulse signal 255*a*, a first low level signal 256*a*, a seventh VCLK pulse signal 257*a*, an eighth VCLK pulse signal 258*a* and a second low level signal 259*a*. An STV signal 24*a* in the display section 40 is a high level signal 241*a* at the eighth VCLK pulse signal 258*a*. An OE signal 26*a* in the display section 40 comprises cyclic signals and each cyclic signal comprises sequential signals of a first OE low potential signal 260*a*, a second OE low potential signal 261*a*, a third OE low potential signal 262*a*, a fourth OE low potential signal 263*a*, a fifth OE low potential signal 264*a*, a sixth OE low potential signal 265*a*, a first OE high potential signal 266*a*, a seventh OE low potential signal 267*a*, an eighth OE low potential signal 268*a* and a second OE high potential signal 269*a*.

A VCLK signal 25*a* in a BI section 41 comprises cyclic signals and each cyclic signal comprises sequential signals of a first VCLK pulse signal 250*b*, a second VCLK pulse signal 251*b*, a third VCLK pulse signal 252*b*, a fourth VCLK pulse signal 253*b*, a fifth VCLK pulse signal 254*b*, a sixth VCLK pulse signal 255*b*, a first low level signal 256*b*, a seventh VCLK pulse signal 257*b*, a eighth VCLK pulse signal 258*b* and a second low level signal 259*b*. An STV signal 24*a* in the BI section 41 is a high level signal 240*b* during the eighth VCLK pulse signal 258*b* of a cyclic signal of the VCLK signal 25*a* and the first VCLK pulse signal 250*b* of next cyclic signal of the VCLK signal 25*a;* and is a high level signal 241*b* during the fourth VCLK pulse signal 253*b* of the next cyclic signal of the VCLK signal 25*a* and the fifth VCLK pulse signal 254*b* of the next cyclic signal of the VCLK signal 25*a*. An OE signal 26*a* in the BI section 41 comprises cyclic signals and each cyclic signal comprises sequential signals of a first OE high potential signal 260*b*, a second OE high potential signal 261*b*, a third OE high potential signal 262*b*, a fourth OE high potential signal 263*b*, a fifth OE high potential signal 264*b*, a sixth OE high potential signal 265*b*, a first OE low potential signal 266*b*, a seventh OE high potential signal 267*b*, an eighth OE high potential signal 268*b*, and a second OE low potential signal 269*b*.

Figure 7:
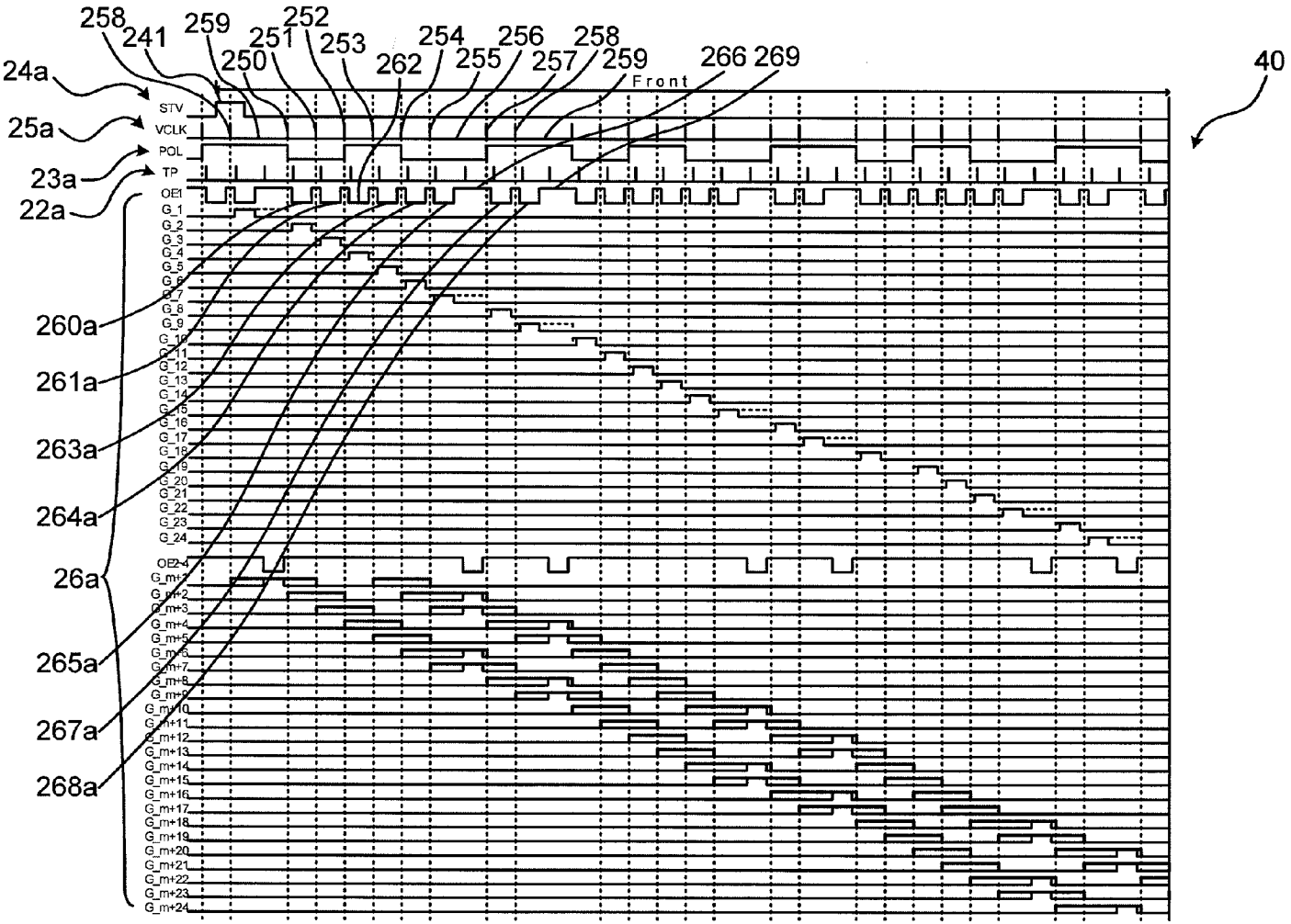
FIG. 7 is the view showing the waveforms of the display section of the second preferred embodiment.

FIG. 7 shows control waveforms of input part of the display section 40. After the STV signal 24*a* is triggered by the VCLK signal 25*a*, all gates except the first gate are cyclically opened for six time periods or two time periods together with an interval of one time period to write in display signals line by line through controls by the VCLK signal 25*a* and the OE signal 26*a*. A display of 1+2 line inversion is obtained with a design of a POL signal 23*a*, where four gates are processed with BI action at a certain position on a screen during the interval.

Figure 8:
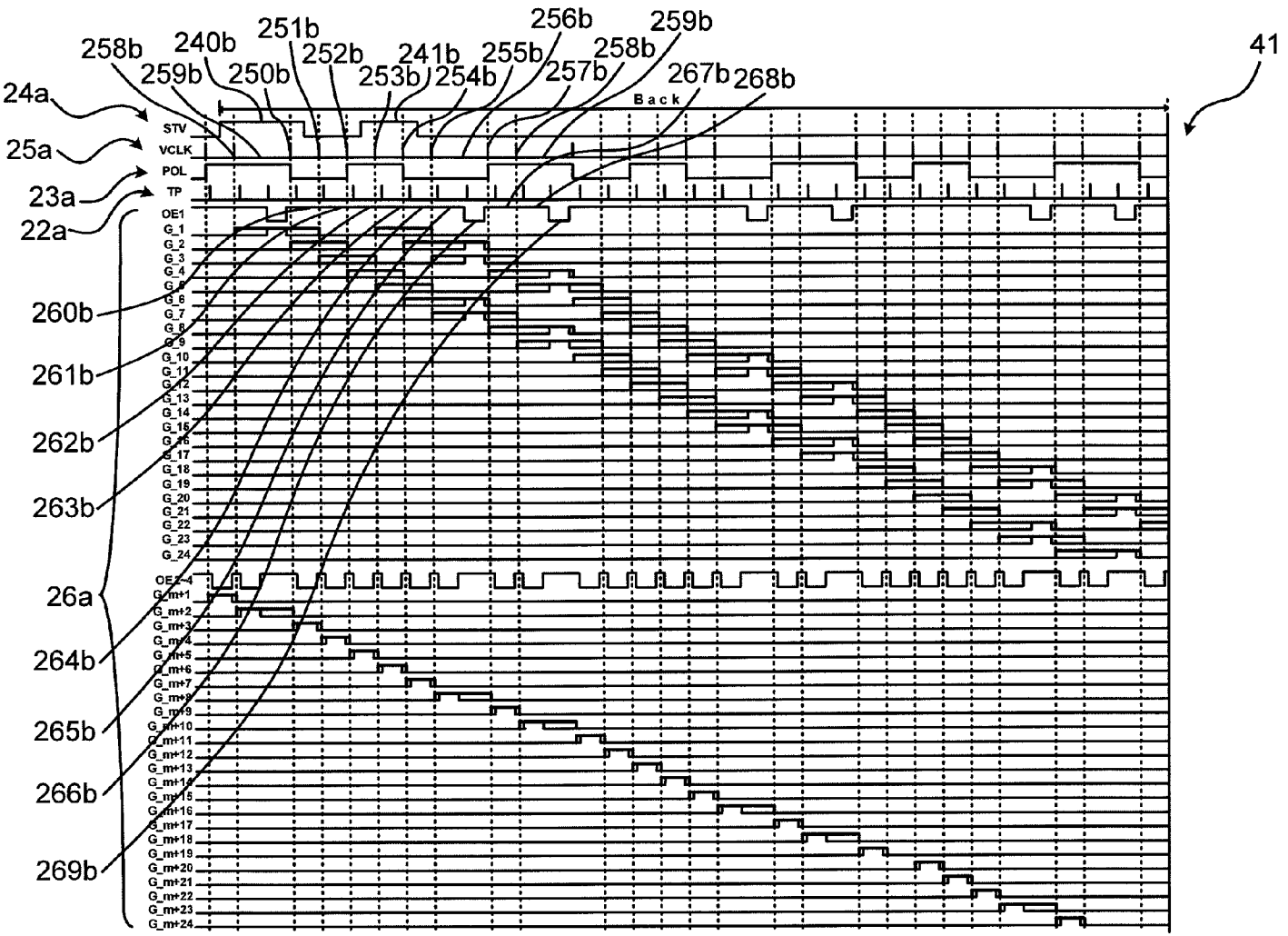
FIG. 8 is the view showing the waveforms of the BI section of the second preferred embodiment.

As shown in FIG. 8, the STV signal 24*a* in the BI section comprises a high level signal 240*b* crossing two VCLK signals 25*a* (having an interval of a VCLK signal wide between the two signals); a low level signal crossing two VCLK signals 25*a*; and a high level signal 241*b* crossing two VCLK signals 25*a*. Through controls by the VCLK signal 25*a* and the OE signal 26*a*, all gates except the first gate are cyclically opened for six time periods or two time periods. And four gates are opened at one time to write in BI signals with the same polarities, where data are simultaneously displayed at a certain position on a screen during the interval.

Figure 9:
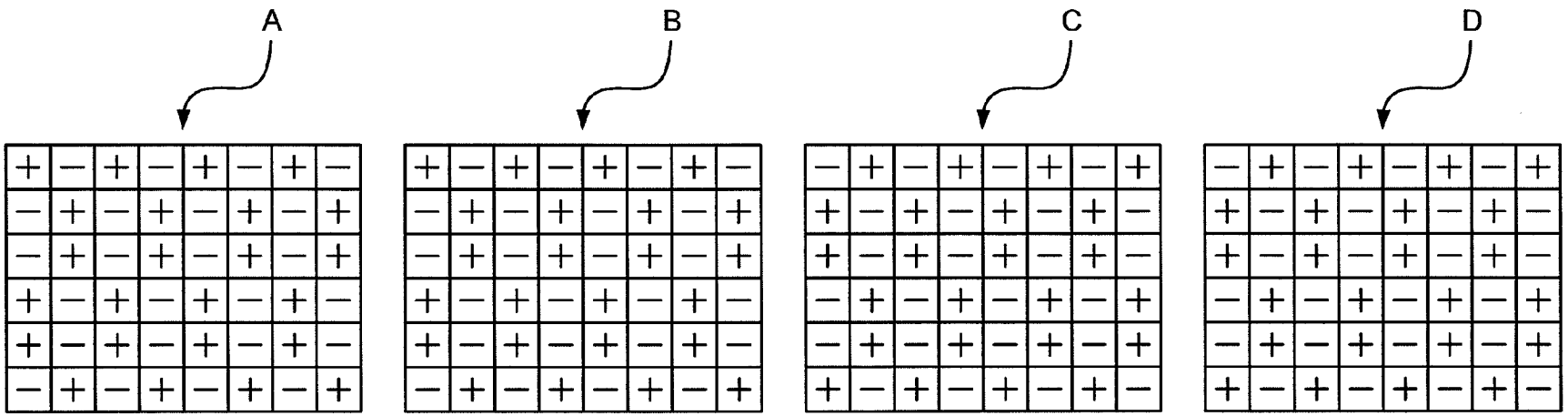
FIG. 9 is the view showing the polarities of the second preferred embodiment.

FIG. 9 shows polarities of screens. Polarities of screen A, B, C and D are coincident no mater in the BI section or in the display section.

Figure 10:
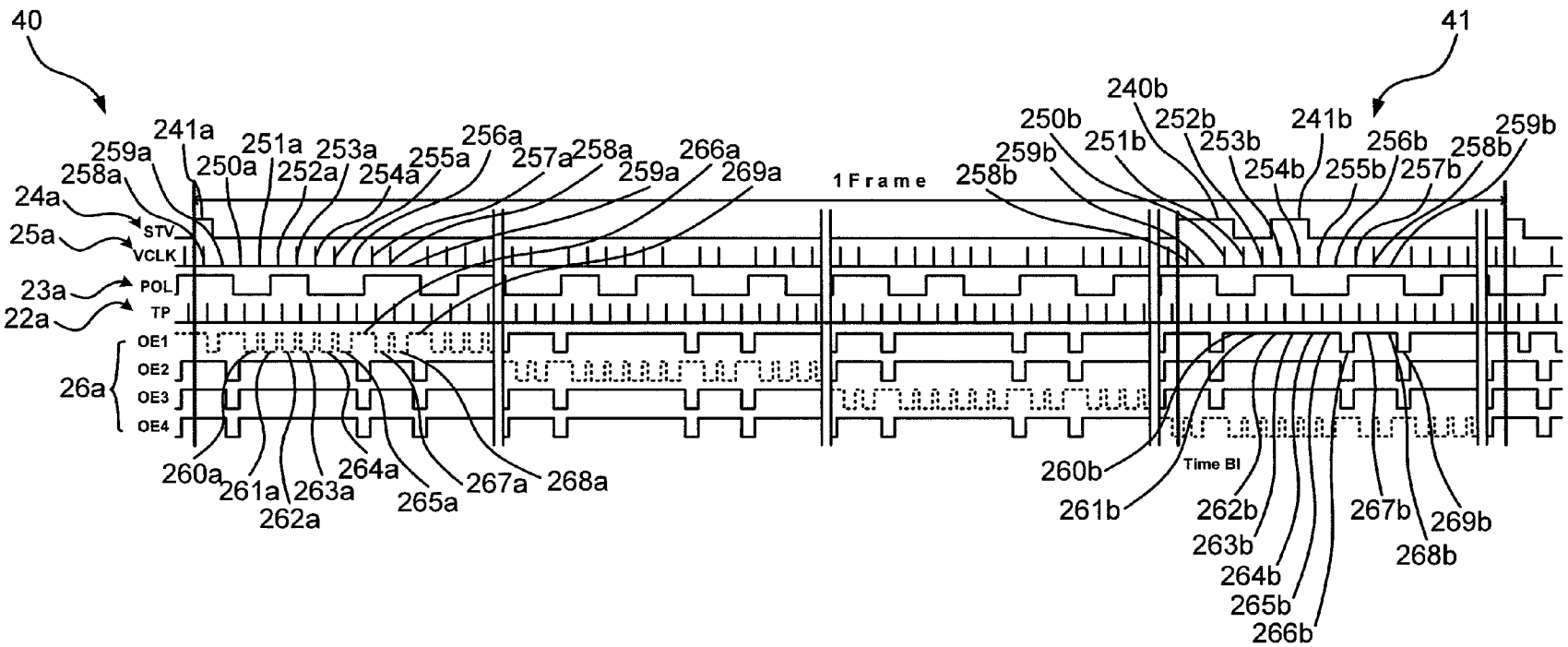
FIG. 10 is the view showing the waveforms of the second preferred embodiment.
Figure 11:
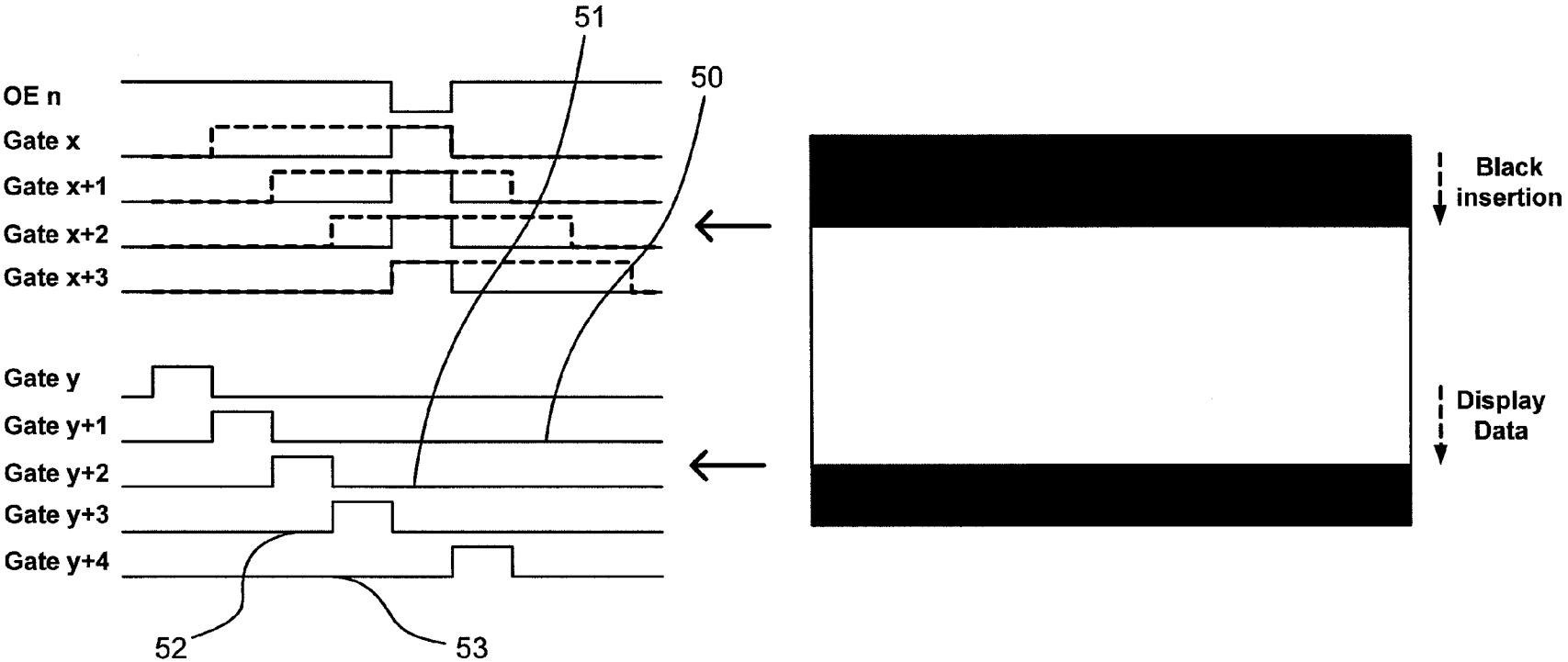
FIG. 11 is the view of the general BI section.

As shown in FIG. 10, dotted-line parts of the OE signal 26*a* are the parts for displaying data and the other parts are for BI, where the dotted-line parts are shifted from OE1 through OE4 and are followed by displaying the data to finish a frame. When a certain position of the screen is processed with the displaying, BI signal is opened with four lines at one time for a BI of 1+2 line inversion. When start time of the Time BI is different, BI on the screen has a different ratio; but the BI is not processed at the dotted-line parts. The number of signals in the OE signal 26*a* (number of integrated circuits) is not limited yet greater than two, which comprises four time periods for horizontal display signal and one time period for horizontal BI signal with display frequency improved for (4+1)/4=1.25 times To sum up, the present invention is a dynamic image control device using coincident BI signals, where MPRT of a board is reduced through using BI technology; BI signals are displayed in a way of 1+2 line inversion with STV, VCLK and OE control signals for coinciding polarities of display data with those of BI data; and differences of response times for displaying data are thus eliminated.

The preferred embodiments herein disclosed are not intended to unnecessarily limit the scope of the invention. Therefore, simple modifications or variations belonging to the equivalent of the scope of the claims and the instructions disclosed herein for a patent are all within the scope of the present invention.

What is claimed is:

1. A dynamic image control device using coincident blank insertion signals, comprising:

a sequence control unit, said sequence control unit controlling timing sequence data;

a data access unit, said data access unit connecting to said sequence control unit, said data access unit accessing required data;

a buffer unit, said buffer unit connecting to said data access unit, said buffer unit buffering said required data;

a register, said register connecting to said sequence control unit, said register buffering said timing sequence data;

a memory unit, said memory unit connecting to said register, said memory unit storing said timing sequence settings;

a data output unit, said data output unit connecting to said sequence control unit and said data access unit, said data output unit outputting an reduce swing differential signal; and a driving signal unit, said driving signal unit connecting to said data sequence control unit and said register, said driving signal unit outputting a output signal, a transference control signal, a polarity control signal, a start pulse signal, a clock signal and a plurality of output control signals, wherein control waveform of each of said transference control signal, said polarity control signal, said start pulse signal, said clock signal and each of said output control signals is divided into a display section and a blank insertion section;

wherein said clock signal in said display section comprises cyclic signals and each cyclic signal comprises sequential signals of a first clock pulse signal and a second clock pulse signal;

wherein said start pulse signal in said display section is a high level signal at said second clock pulse signal;

wherein said output control signal in said display section comprises cyclic signals and each cyclic signal comprises sequential signals of a first output control low potential signal, an output control high potential signal and a second output control low potential signal;

wherein said clock signal in said blank insertion section comprises cyclic signals and each cyclic signal comprises sequential signals of a first clock pulse signal and a second clock pulse signal;

wherein said start pulse signal in said blank insertion section is a high level signal during said second clock pulse signal of a cyclic signal of said clock signal and said first clock pulse signal of next cyclic signal of said clock signal; and wherein said output control signal in said blank insertion section comprises cyclic signals and each cyclic signal comprises sequential signals of a first output control high potential signal, an output control low potential signal and a second output control high potential signal sequentially.

2. The device according to claim 1, wherein said reduce swing differential signal, said output signal, said transference control signal and said polarity control signal are outputted to a source driving unit.

3. The device according to claim 1, wherein said start pulse signal, said clock signal and said plurality of output control signals are outputted to a gate driving unit.

4. A dynamic image control device using coincident blank insertion signals, comprising:

a sequence control unit, said sequence control unit controlling timing sequence data;

a data access unit, said data access unit connecting to said sequence control unit, said data access unit accessing required data;

a buffer unit, said buffer unit connecting to said data access unit, said buffer unit buffering said required data;

a register, said register connecting to said sequence control unit, said register buffering said timing sequence data;

a memory unit, said memory unit connecting to said register, said memory unit storing said timing sequence settings;

a data output unit, said data output unit connecting to said sequence control unit and said data access unit, said data output unit outputting an reduce swing differential signal; and a driving signal unit, said driving signal unit connecting to said data sequence control unit and said register, said driving signal unit outputting a output signal, a transference control signal, a polarity control signal, a start pulse signal, a clock signal and a plurality of output control signals, wherein control waveform of each of said transference control signal, said polarity control signal, said start pulse signal, said clock signal and each of said output control signals is divided into a display section and a blank insertion section;

wherein said clock signal in said display section comprises cyclic signals and each cyclic signal comprises sequential signals of a first clock pulse signal, a second clock pulse signal, a third clock pulse signal, a fourth clock pulse signal, a fifth clock pulse signal, a sixth clock pulse signal, a first low level signal, a seventh clock pulse signal, an eighth clock pulse signal and a second low level signal;

wherein said start pulse signal has a high level at said eighth clock pulse signal;

wherein said output control signal in said display section comprises cyclic signals and each cyclic signal comprises sequential signals of a first output control low potential signal, a second output control low potential signal, a third output control low potential signal, a fourth output control low potential signal, a fifth output control low potential signal, a sixth output control low potential signal, a first output control high potential signal, a seventh output control low potential signal, an eighth output control low potential signal, and a second output control high potential signal;

wherein said clock signal in said blank insertion section comprises cyclic signals and each cyclic signal comprises sequential signals of a first clock pulse signal, a second clock pulse signal, a third clock pulse signal, a fourth clock pulse signal, a fifth clock pulse signal, a sixth clock pulse signal, a first low level signal, a seventh clock pulse signal, a eighth clock pulse signal and a second low level signal;

wherein said start pulse signal in said blank insertion section is a high level signal during said eighth clock pulse signal of a cyclic signal of said clock signal and said first clock pulse signal of next cyclic signal of said clock signal;

wherein said start pulse signal in said blank insertion section is a high level during said fourth clock pulse signal of said next cyclic signal of said clock signal and said fifth clock pulse signal of said next cyclic signal of said clock signal; and wherein said output control signal in said blank insertion section comprises cyclic signals and each cyclic signal comprises sequential signals of a first output control high potential signal, a second output control high potential signal, a third output control high potential signal, a fourth output control high potential signal, a fifth output control high potential signal, a sixth output control high potential signal, a first output control low potential signal, a seventh output control high potential signal, an eighth output control high potential signal, and a second output control low potential signal sequentially.

5. The device according to claim 4, wherein said reduce swing differential signal, said output signal, said transference control signal and said polarity control signal are outputted to a source driving unit.

6. The device according to claim 4, wherein said start pulse signal, said clock signal and said plurality of output control signals are outputted to a gate driving unit.

* * * * *